United States Patent [19]

Brotherston

[11] 4,358,255

[45] Nov. 9, 1982

[54] LIQUID FUEL INJECTION PUMPING APPARATUS

[75] Inventor: Colin P. Brotherston, Rainham, England

[73] Assignee: Lucas Industries Limited, Birmingham, England

[21] Appl. No.: 110,743

[22] Filed: Jan. 9, 1980

[51] Int. Cl.[3] ..... F04B 19/00; F04B 29/00

[52] U.S. Cl. ..... 417/462; 417/218

[58] Field of Search ..... 417/252, 253, 218, 220, 417/221, 462

[56] References Cited

U.S. PATENT DOCUMENTS

| | | | |
|---|---|---|---|
| 3,000,318 | 9/1961 | Volossevich | 417/462 |
| 3,847,509 | 11/1974 | Bonin | 417/462 |
| 3,910,723 | 10/1975 | Bonin | 417/462 |
| 4,125,104 | 11/1978 | Stein | 417/462 |
| 4,292,012 | 9/1981 | Brotherston | 417/462 |

FOREIGN PATENT DOCUMENTS

| | | | |
|---|---|---|---|
| 850353 | 4/1959 | United Kingdom | 417/253 |

*Primary Examiner*—William L. Freeh

[57] ABSTRACT

A liquid fuel injection pumping apparatus includes a rotary distributor member housed in a sleeve mounted in a body. The distributor member is movable in an axial direction and mounts a pumping plunger in a transverse bore. An inclined surface is formed on the plunger for co-operation to limit the outward movement of the plunger, with an inclined surface on a part in the form of a strip. The strip rotates with the distributor member but is restricted against axial movement. Hence axial movement of the distributor member varies the amount of outward movement of the plunger and hence the amount of fuel which can be supplied by the apparatus.

10 Claims, 3 Drawing Figures

LIQUID FUEL INJECTION PUMPING APPARATUS

This invention relates to a liquid fuel injection pumping apparatus for supplying fuel to internal combustion engines and of the kind comprising a body part, a rotary distributor member mounted in the body part and arranged in use, to be driven in timed relationship with an engine with which the apparatus is associated, a transverse bore formed in the distributor member, a plunger in said bore, a cam follower positioned at the outer end of said plunger for engagement with a cam surface formed on a cam ring surrounding the distributor member, stop means for limiting the outward movement of the plunger and passage means for conveying fuel to and from said bore during rotation of the distributor member.

In apparatus of the aforesaid kind, it is necessary to be able to vary the amount of fuel delivered by the apparatus in order to control the amount of fuel delivered to the associated engine. This can be achieved using a throttle through which fuel flows to the bore from a source under pressure. However, the amount of fuel flowing to the bore for a given setting of the throttle will vary as the speed of the engine varies. For example as the engine speed increases the amount of fuel delivered to the engine each time the plunger is moved inwardly, will decrease and conversely if the speed is reduced, then the amount of fuel delivered to the engine will increase and possibly in this instance, the stop means will come into operation to determine the maximum quantity of fuel which can be delivered. In order to ensure that the amount of fuel delivered each time the plunger moves inwardly remains constant irrespective of the engine speed, the throttle must be adjusted each time there is a change in speed or alternatively, the pressure of fuel upstream of the throttle must be varied. It is not therefore very easy to provide this form of apparatus with a control member which when moved to a particular position will ensure that a pre-established quantity of fuel will be delivered to the engine whatever the engine speed.

Another way of obtaining variation of the amount of fuel delivered to the engine is to measure a quantity of fuel in a variable volume chamber in the body part and then to transfer the measured quantity of fuel to the bore. The measurement can be effected using a shuttle the stroke of which in the cylinder can be adjusted directly, for example by means of an adjustable stop. This arrangement in theory will provide for direct variation of the amount of fuel delivered during inward movement of the plunger in accordance with the setting of the adjustable stop. Unfortunately, this form of apparatus suffers from problems in transferring the fuel from the cylinder to the bore and in practice it is found that there may be considerable variation in the amount of fuel delivered for a given setting of the adjustable stop, as the speed of the associated engine varies.

It is also known to control the amount of fuel delivered during the inward movement of the plunger by adjusting the stop means so that in effect the plunger acts as the aforesaid shuttle but without the practical problem of transferring the fuel to the bore. Such an apparatus is shown in the specification of British Patent 1,171,226. In the apparatus shown in this specification, a fork having an inclined surface for co-operation with a complementary surface on the follower is provided and the fork is connected to or forms part of a sleeve which is mounted for axial movement upon a drive shaft which is rotatable with the distributor member. A problem with this arrangement is the fact that the sleeve rotates with the shaft and has to be connected for the purpose of adjustment, to an adjustable part fixed within the body part of the apparatus. Any lost motion between the sleeve and the aforesaid part can upset the calibration of the apparatus besides which the friction between the sleeve and the shaft will ensure that more effort is required to effect movement of the sleeve.

The object of the present invention is to provide an apparatus of the kind specified in a simple and convenient form.

According to the invention, in an apparatus of the kind specified the distributor member is axially movable within the body part and the apparatus also comprises means for varying the axial setting of the distributor member, and said stop means comprises complementary inclined surfaces on the plunger and a part which is rotatable with the distributor member but which is axially fixed within the body part, whereby as the distributor member is moved axially within the body part the amount by which the plunger can move outwardly whilst fuel is supplied to the bore will vary.

According to a further feature of the invention, said part extends within a slot defined in the distributor member and acts to impart rotary movement thereto.

One example of a fuel pumping apparatus in accordance with the invention will now be described with reference to the accompanying drawings in which.

Figure 1:
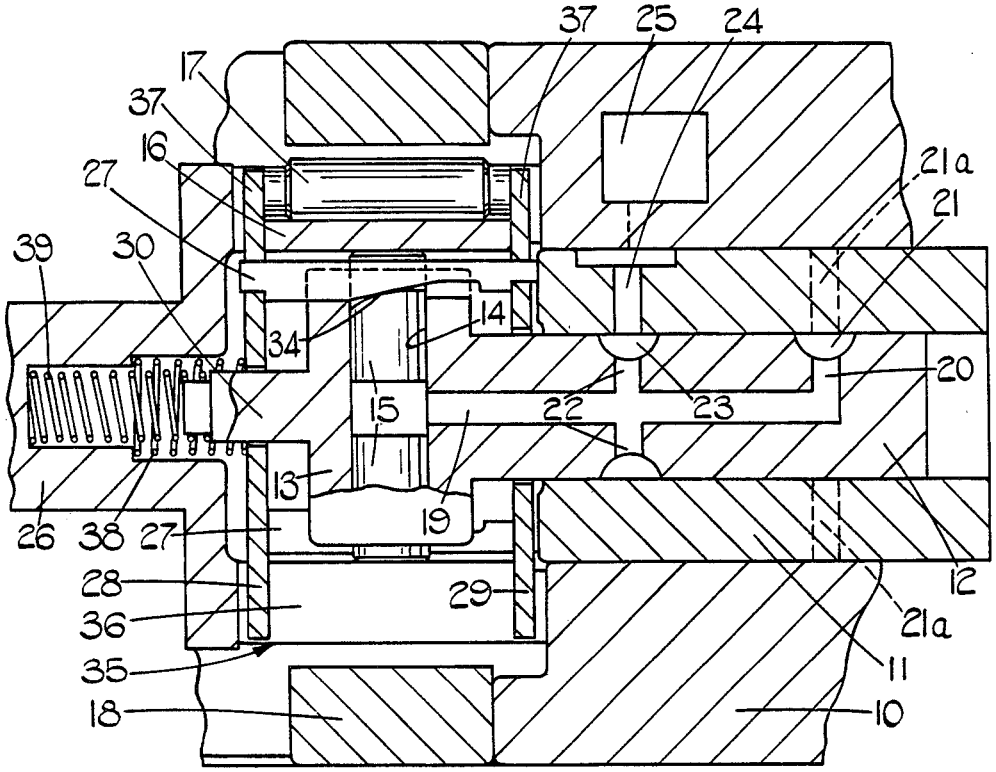
FIG. 1 is a sectional side elevation showing a part of the apparatus.
Figure 2:
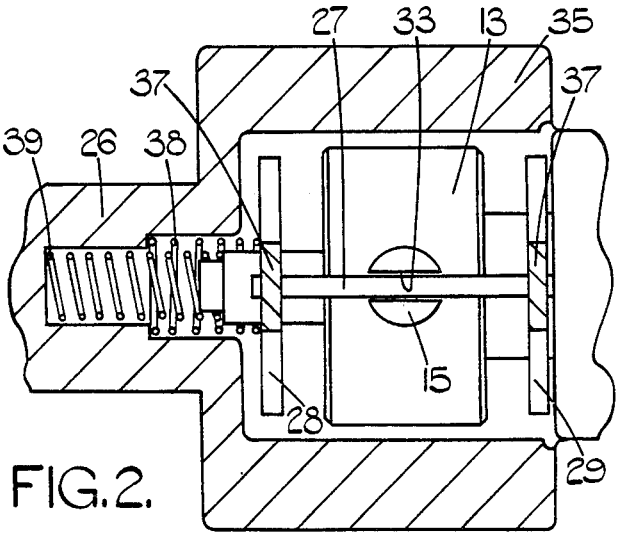
FIG. 2 is a plan view of part of the apparatus seen in FIG. 1 with parts removed for the sake of clarity.

With reference to the drawings, the apparatus comprises a body part which includes a housing 10 in which is secured a sleeve 11. The sleeve mounts a rotary distributor member 12 which as will be explained, in use, is driven in timed relationship with the associated engine. The distributor member at one end has a head portion 13 within which is formed a transversely extending bore 14. The bore mounts a pair of pumping plungers 15 which at their outer ends contact shoes 16 respectively, the shoes mounting rollers 17.

The rollers 17 as the distributor member rotates, engage with cam lobes formed on the internal peripheral surface of an annular cam ring 18. When the plungers 15 are moved inwardly, fuel is displaced from the bore 14 along a longitudinal passage 19 formed in the distributor member. At one point this passage communicates with a radially extending delivery passage 20 itself terminating in an axially extending slot 21. The slot 21 is arranged to register in turn as the distributor member rotates, with a plurality of outlet ports **21*a* which in use are connected to the injection nozzles of the associated engine respectively. The communication of the slot 21 with one of the outlets 21*a*** takes place during the time when the plungers are moved inwardly by the cam lobes.

The passage 19 also communicates with a pair of radially extending inlet passages 22 which at their outer ends terminate in axial slots 23. The slots 23 register in turn with a pair of inlet ports 24 formed in the sleeve 11 at right angles to each other and which are in constant communication with a source 25 of fuel under pressure.

This source of fuel may be a vane type pump the rotary part of which is coupled to an input shaft 26 and the output pressure of the vane pump will be controlled by a relief valve. In use, fuel is supplied to the bore 14 to effect outward movement of the plungers 15 when an inlet port 24 is in communication with a slot 23. Such communication occurs whilst the plungers 15 are permitted outward movement by the cam lobes. Moreover, the plungers move outwardly a predetermined extent as will be explained. As the distributor member rotates, the slot 23 moves out of register with the port 24 and the slot 21 moves into register with one of the outlet ports 21*a*. Further angular movement of the distributor member causes inward movement to be imparted to the plungers 15 so that fuel is delivered to the respective injection nozzles.

The extent of outward movement of the plunger is determined by a pair of parts which are in the form of metal strips 27. The strips 27 have stepped ends which are located in and extend through apertures respectively formed in a pair of generally annular members 28, 29 disposed on opposite sides of the enlarged portion 13 of the distributor member. The member 29 can engage with an end surface of the housing 10 and in addition the end surfaces of the strips 27 can engage with the end surface of the sleeve 11. The part 28 is located about an extension 30 of the distributor member and furthermore, is biased by means of a coiled compression spring 38, in a direction towards the sleeve 11.

The enlarged portion 13 of the distributor member is provided with a pair of axial slots 32, through which the strips 27 respectively extend. Moreover, each plunger is provided with a slot 33 and the respective strips pass through the slots. The base walls of the slots in the plungers are inclined for co-operation with complementary surfaces 34 defined upon the strips 27 respectively, and the arrangement is such that the permitted outward movement of the plungers 15 depends upon the axial setting of the distributor member. As shown in the drawing, if the distributor member is moved towards the right then the plungers 15 will be able to move outwardly an additional amount.

The aforesaid drive shaft 26 is provided with a cup shaped extension 35 which surrounds the enlarged portion of the distributor member and which has formed in it a pair of diametrically disposed radially extending slots 36. Located within these slots 36 are the shoes 16 and the rollers 17 and the side walls of the slots bear against the shoes to impart rotary movement thereto. In addition, the members 28 and 29 are provided with extensions 37 which locate within the slots 36 so that the members 28 and 29 are driven by the drive shaft. The strips 27 being connected to the members 28 and 29 are also driven and in turn impart drive to the distributor member.

The spring 38 which biases the member 28, the strips 27 and the member 29 in the axial direction, engages at its end remote from the member 28, a step defined in a bore in the drive shaft 26. There is also accommodated within this bore a further coiled compression spring 39 which acts upon the extension 30 of the distributor member and therefore biases the distributor member towards the right as seen in FIG. 1.

Movement of the distributor member against the action of the spring 39 can be achieved in a number of ways. For example, fluid under pressure can be applied to the right hand end of the distributor member, the fluid pressure being controlled in any convenient manner, to obtain variation in the amount of fuel supplied to the engine. Alternatively, the axial setting of the distributor member may be achieved by mechanical means including a lever engaging with the end of the distributor member remote from the spring 39. This lever can act substantially at the axis of rotation of the distributor member to minimise friction.

In a modification, instead of a single strip 27 being provided for engagement by the plunger, there may be provided a pair of strips. In this case two pairs of slots 36 must be provided in the enlarged portion 13 of the distributor member and in addition the plungers are modified so as to define a pair of surfaces for engagement by the strips with a central portion extending between the strips for engagement with the respective shoe 16.

In the construction described with reference to the drawings the strips 27 do not extend outwardly beyond the outer ends of the slots 36 in the enlarged portion 13 of the distributor member. As a result, the depth of the slots 33 in the plungers has to be sufficient to allow the plungers to project beyond the strips 27 for engagement with the shoes in the minimum fuel position. This also results in plungers of such a length that there can be a problem with side loading of the plungers.

Figure 3:
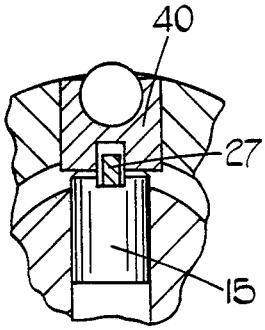
FIG. 3 is a part sectional end elevation showing a modification.

In order to minimise the side loading, and as shown in FIG. 3, the shoes 40 can be provided with slots, and the plungers made shorter so that the strips 27 extend beyond the ends of the plungers and can be accommodated without contact, in the slots formed in the shoes. The shoes will in fact be increased in depth by substantially the same amount as the plungers are reduced in length.

As shown in the drawings failure of the positioning arrangement for the distributor member will result in movement of the distributor member to the right under the action of the spring 39. This will result in the maximum delivery of fuel by the apparatus. If desired and to achieve the opposite effect, the co-operating surfaces on the strips 27 and plungers can be inclined in the opposite direction.

I claim:

1. A liquid fuel injection pumping apparatus for supplying fuel to internal combustion engines and of the kind comprising a body part, a rotary distributor member mounted in the body part and arranged in use, to be driven in timed relationship with an engine with which the apparatus is associated, a transverse bore formed in the distributor member, a plunger in said bore, a cam follower positioned at the outer end of said plunger for engagement with a cam surface formed on a cam ring surrounding the distributor member, stop means for limiting the outward movement of the plunger and passage means for conveying fuel to and from said bore during rotation of the distributor member, characterised in that the distributor member is axially movable within the body part and the apparatus also comprises means for varying the axial setting of the distributor member, and said stop means comprises complementary inclined surfaces on the plunger and a part which is rotatable with the distributor member but which is axially fixed within the body part, whereby as the distributor member is moved axially within the body part the amount by which the plunger can move outwardly whilst fuel is supplied to the bore will vary.

2. An apparatus according to claim 1 including a slot formed in the distributor member, said part extending within said slot and acting to transmit rotary movement to the distributor member.

3. An apparatus according to claim 2 including a drive shaft mounted in the body part and having a cup shaped portion surrounding the distributor member, an axial slot formed in the cup shaped portion, said cam follower being located in said slot for radial movement therein, an annular member located within said cup shaped portion, said annular member having an extension located in said slot and said part being engaged with said annular member whereby the distributor member is driven from said cup shaped portion through said annular member and said part.

4. A liquid fuel injection pumping apparatus for supplying fuel to internal combustion engines and of the kind comprising a body part, a rotary distributor member mounted in the body part and arranged in use, to be driven in timed relationship with an engine with which the apparatus is associated, a transverse bore formed in the distributor member, a plunger in said bore, a cam follower positioned at the outer end of said plunger for engagement with a cam surface formed on a cam ring surrounding the distributor member, stop means for limiting the outward movement of the plunger and passage means for conveying fuel to and from said bore during rotation of the distributor member, characterized in that the distributor member is axially movable within the body part and the apparatus also comprises means for varying the axial setting of the distributor member, said stop means comprises complementary inclined surfaces on the plunger and a metal strip which is rotatable with the distributor member but which is axially fixed within the body part, whereby as the distributor member is moved axially within the body part the amount by which the plunger can move outwardly while fuel is supplied to the bore will vary, and there is further provided a slot formed in the distributor member, said metal strip extending within said slot and acting to transmit rotary movement to the distributor member, a drive shaft mounted in the body part and having a cup shaped portion surrounding the distributor member, an axial slot formed in the cup shaped portion, said cam follower being located in said axial slot for radial movement therein, an annular member located within said cup shaped portion, said annular member having an extension located in said axial slot, and said metal strip being engaged with said annular member whereby the distributor member is driven from said cup shaped portion through said annular member and said metal strip, and said metal strip extends into a slot formed in the outer end of the plunger, the base wall of the slot in the plunger and the edge of the strip presented thereto being inclined to the axis of rotation of the distributor member, said strip having a stepped end located in and extending through an aperture in said annular member.

5. An apparatus according to claim 4 in which the face of the follower presented to the plunger is provided with a slot which is aligned with the slot in the plunger, said metal strip being partly located in the slot in the follower.

6. An apparatus according to claim 4 in which there are a pair of spaced metal strips, the plunger being provided with a pair of surfaces for engagement with said strips respectively.

7. An apparatus according to claim 4 including resilient means biasing said annular member and said metal strip in one axial direction so that the end of the strip remote from the drive shaft engages with a part of the body.

8. An apparatus according to claim 7 including further resilient means biassing the distributor member in one axial direction.

9. An apparatus according to claim 8 in which said resilient means each comprises coiled compression springs which are in part located within a bore in the distributor member.

10. A liquid fuel injection pumping apparatus for supplying fuel to internal combustion engines and of the kind comprising a body part, a rotary distributor member mounted in the body part and arranged in use, to be driven in timed relationship with an engine with which the apparatus is associated, a transverse bore formed in the distributor member, a plunger in said bore, a cam follower positioned at the outer end of said plunger for engagement with a cam surface formed on a cam ring surrounding the distributor member, stop means for limiting the outward movement of the plunger and passage means for conveying fuel to and from said bore during rotation of the distributor member, characterized in that the distributor member is axially movable within the body part and the apparatus also comprises means for varying the axial setting of the distributor member, said stop means comprises complementary inclined surfaces on the plunger and a part which is rotatable with the distributor member but which is axially fixed within the body part, whereby as the distributor member is moved axially within the body part the amount by which the plunger can move outwardly while fuel is supplied to the bore will vary, and there is further provided a slot formed in the distributor member, said part extending within said slot and acting to transmit rotary movement to the distributor member, a drive shaft mounted in the body part and having a cup shaped portion surrounding the distributor member, an axial slot formed in the cup shaped portion, said cam follower being located in said axial slot for radial movement therein, an annular member located within said cup shaped portion, said annular member having an extension located in said axial slot, and said part being engaged with said annular member whereby the distributor member is driven from said cup shaped portion through said annular member and said part, said distributor member having an enlarged portion which is surrounded by said cup shaped portion of the drive shaft, said annular member being located on one side of said enlarged portion and there is a further annular member located on the opposite side of the enlarged portion, said further annular member having an extension located in said axial slot, and said part being engaged with said further annular member.

* * * * *